United States Patent [19]

Itakura

[11] Patent Number: 4,726,325

[45] Date of Patent: Feb. 23, 1988

[54] COOLING SYSTEM CONTROLLER FOR INTERNAL COMBUSTION ENGINES

[75] Inventor: Masato Itakura, Toyota, Japan

[73] Assignee: Aisin Seiki Kabushki Kaisha, Kariya, Japan

[21] Appl. No.: 31,669

[22] Filed: Mar. 30, 1987

[30] Foreign Application Priority Data

Mar. 28, 1986 [JP] Japan ..... 61-70183

[51] Int. Cl.[4] ..... F01P 3/20

[52] U.S. Cl. ..... 123/41.1; 123/41.44; 123/41.82 R

[58] Field of Search ..... 123/41.08, 41.09, 41.1, 123/41.02, 41.44, 41.82 R, 41.29

[56] References Cited

U.S. PATENT DOCUMENTS

| | | | |
|---|---|---|---|
| 3,964,449 | 6/1976 | Thien et al. | 123/41.51 |
| 4,061,187 | 12/1977 | Rajasekaran et al. | 123/41.29 |
| 4,186,693 | 2/1980 | Thien et al. | 123/41.51 |
| 4,369,738 | 1/1983 | Hirayama | 123/41.29 |
| 4,370,950 | 2/1983 | Furukubo | 123/41.29 |
| 4,381,736 | 5/1983 | Hirayama | 123/41.29 |
| 4,413,596 | 11/1983 | Hirayama | 123/41.29 |
| 4,423,705 | 1/1984 | Morita et al. | 123/41.29 |
| 4,449,486 | 5/1984 | Kin | 123/41.29 |
| 4,539,942 | 9/1985 | Kobayashi et al. | 123/41.29 |

FOREIGN PATENT DOCUMENTS

| | | | |
|---|---|---|---|
| 2112922 | 7/1983 | United Kingdom | 123/41.51 |

*Primary Examiner*—William A. Cuchlinski, Jr.
*Attorney, Agent, or Firm*—Oblon, Fisher, Spivak, McClelland & Maier

[57] ABSTRACT

A cooling control system for internal combustion engines having two circuits of cooling water for cylinder head side and cylinder block side, each of two circuits being provided with a radiator, a water jacket, a water pump, a conduit, a return passageway, a by-pass passageway, a mixing valve device, and a motor fan; said water pump being driven by a rotation-controllable electric motor, said valve device being driven by a DC motor or a stepping motor which is controlled by a control unit operating by receiving signals on various vehicle running conditions, thereby making it possible to perform the optimum water distribution according to various vehicle running conditions under the high accuracy of control.

1 Claim, 4 Drawing Figures

COOLING SYSTEM CONTROLLER FOR INTERNAL COMBUSTION ENGINES

BACKGROUND OF THE INVENTION

1. Field of the Invention

This invention relates to a cooling system controller for internal combustion engines which can be used for a two-circuits cooling system in which the passageway of cooling water is divided into a cylinder head side circuit and a cylinder block side circuit.

2. Prior Art

In the Japanese Laid-open Patent Bulletin of Toku-kai No. sho 59-215915 (215915/1984), there is proposed a cooling system for internal combustion engines wherein; a cooling water circuit for cylinder head and a cooling water circuit for cylinder block are disposed separately; the temperature of cooling water at the cylinder head side is controlled to be low temperature with the thermostats which are provided to each circuit respectively so that the knocking control and the filling efficiency control are well performed and; the temperature of cooling water at the cylinder block side is controlled to be high temperature so that the temperature of lubrication oil is increased and its friction degree is decreased by reduction of viscosity.

Further, in the Japanese Laid-open Utility Model Bulletin of Jitsu-kai No. sho 60-102422 (102422/1985), there is proposed a cooling system for water-cooled engines in which the setting of temperature of each circuit is performed by a thermostat provided to each circuit as well as by the difference of water flow rate owing to the difference of cross section area between two branch circuit pipes each of which is branched from a common pipe.

The above-described conventional systems, however, have the following drawbacks. Namely, the temperature control by using thermostat has the drawbacks that it cannot follow the variation of vehicle running conditions which always varies during the vehicle run and that an optimum temperature control in accordance with various vehicle running conditions cannot be performed, as the thermostat has drawbacks that its response capability is not high and its set-temperature cannot be changed.

The control system using the difference of cross section area of the branch pipe, too, cannot supply necessary volume of water though it can adjust the water flow ratio between two passageways. Namely, since the water pump as the water flow source is driven by a crank shaft of engine and the water flow rate corresponds to the engine rotation rate, the volume of cooling water supplied to each passageway depends on the rotation rate of the engine and the optimum control of flow rate in accordance with the vehicle running conditions cannot be performed.

A system which intends to improve the response speed is proposed in the Japanese Laid-open Patent Bulletin Toku-kai No. sho 59-213918 (213918/1984). This system employs a control method wherein an electronic control unit judges the signal of the water temperature sensor to position a movable control part of the water flow control valve with a diaphragm by VSV. But this system, too, has a drawback in the accuracy of control. Namely, the conversion of a suction degree to a stroke degree by using diaphragm tends to have a bad influence with the accurate positioning, owing to the friction between parts of the valve and the dynamic or static pressure in the water flow circuit.

A control system which intends to make the set-temperature of thermostat valve to be variable is proposed in the Japanese Laid-open Patent Bulletin Toku-kai No. sho 60-128924 (128924/1985). In this system, the valve open temperature of wax-type thermostat is adjusted by a diaphragm which operates depending on the suctioning force of a suction pipe. But this system, too, has a drawback in the accuracy of control of set-temperature.

SUMMARY OF THE INVENTION

The object of the present invention is to provide a cooling control system for internal combustion engines which can avoid the drawbacks of aforementioned conventional systems and can perform an accurate cooling control in accordance with vehicle running conditions.

In accordance with the present invention, the cooling system has the first and second jackets, the first and second water pumps, the first and second radiators, the first and second conduits, the first and second return passageways, the first and second mixing valve devices, and the first and second motor fans. Said first and second water pumps are driven by an electric motor of which the rotation speed is controllable, while the valves which determine the mixing ratio in the first and second mixing valves devices are driven by a DC motor or a stepping motor. The rotation control of the motors including said motors for motor fans is performed by a control unit which receives from sensors signals on the engine rotation speed, the vehicle speed, the suction force of suction pipe, the water temperature at the inlet ports of said first and second water jackets and ambient air temperature.

The treatment of signals for controlling temperature and the operation of valves are performed electrically, and consequently, the response time can be reduced to the degree of one-to-tens as compared with the conventional wax-type thermostat. It becomes possible to judge the vehicle running conditions and ambient air temperature by a control unit which receives various signals from sensors and thereby to make the set-temperature of valves to be variable. Further, it is possible to make the control of flow rate so as not to depend the rotation rate of engine but to accord the rotation rate of electric motor, thereby make it possible to supply full and necessary volume of water. The accuracy of control, too, is improved as compared with conventional systems, by using electric actuator which is suited for feed-back control and has high resolving power.

Thus, according to the present invention, the engine can always perform optimum temperatrue distribution of water under various vehicle running conditions, and the speed and accuracy of control is improved over the conventional engine. Furthermore, by reducing the rotation speed and rotation frequency of the motor fan, an advantage of reducing noise can be achieved. Also, as it is possible to operate the cooling system even after the engine is stopped, the problem of so-called dead soak is solved and the engine life is prolonged.

The foregoing and other objects, features and advantages of the present invention will be understood more clearly and fully from the following detailed description of preferred embodiments with reference to the attached drawings.

DETAILED DESCRIPTION OF THE PREFERRED EMBODIMENTS

Figure 1:
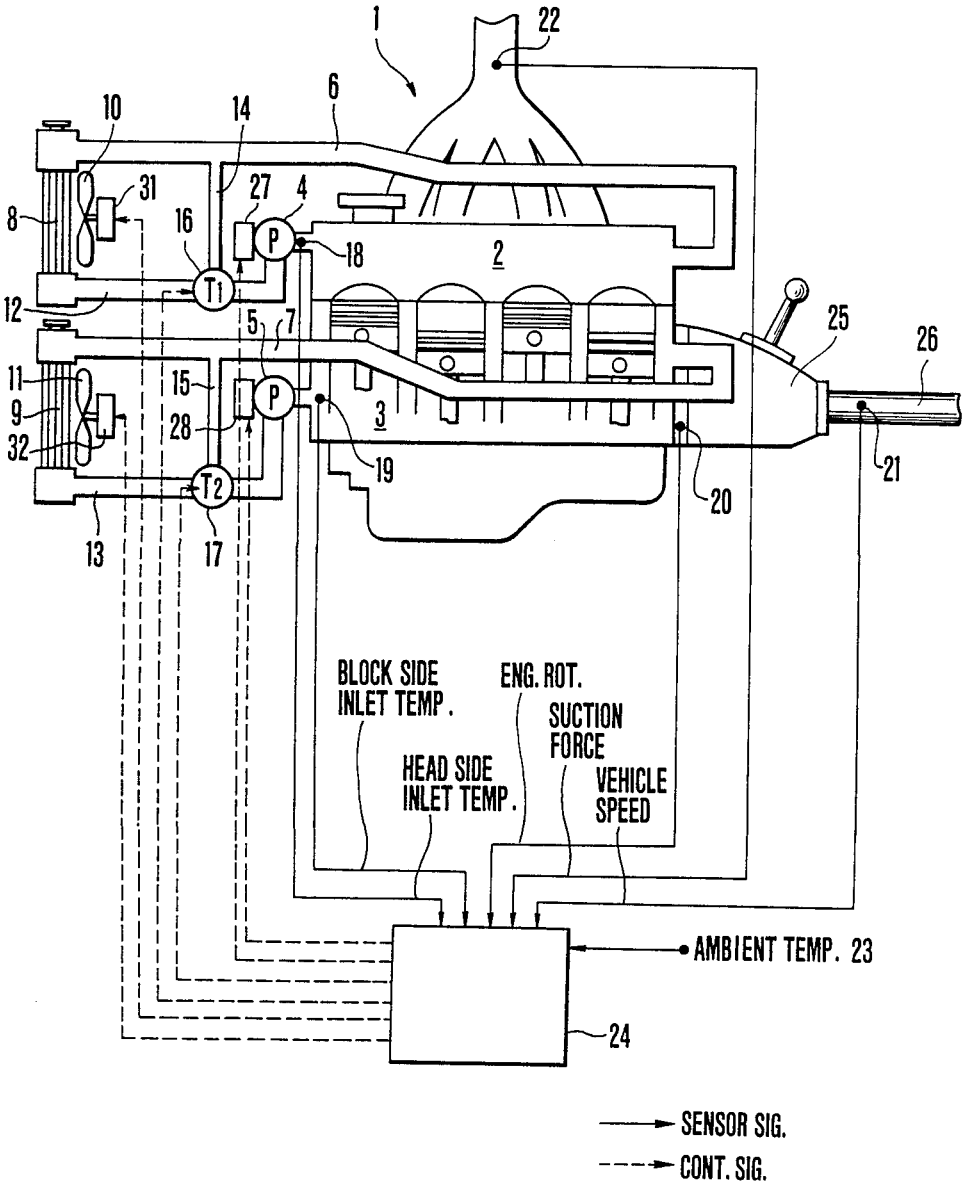
FIG. 1 shows the skeleton of cooling control system of one embodiment of the present invention.

Referring to the drawings, FIG. 1 through FIG. 4 show the embodiment of the present invention. The cooling system controller 1 shown in FIG. 1 has the first water jacket 2 provided in the cylinder head, a second water jacket 3 provided in the cylinder block, the first and second water pumps 4 and 5 provided in the proximity of the inlet port upstream of said first and second jackets respectively, the first and second conduits 6 and 7 which connect the outlet ports downstream of the first and second jackets 2 and 3 with the inlet ports of the first and second radiators 8 and 9 respectively, first and second return passageways 12 and 13 which connect the output ports of said radiators 8 and 9 with the first and second water pumps 4 and 5, the first and second bypass passageways 14 and 15 which branch from the midway of the first and second conduits 6 and 7 to communicate to the midway of the first and second return passageways 12 and 13 respectively, the first and second mixing valves 16 and 17 which are located at the confluence of said bypass passageways 14 and 15 and the first and second return passageways 12 and 13 and mix the cooling water from respective passageways to return the water to the aforementioned first and second water pumps 4 and 5, and the first and second motor fans 10 and 11 which feed cooling air to the first and second radiators 8 and 9 respectively. The first and second water pumps 4 and 5 are driven by speed controllable electric motors 27 and 28, the first and second mixing valves 16 and 17 which determine the mixing ratio are driven by DC motor 29 or stepping motor 30, and the speed of respective motors and motors 31 and 32 for the motor fans 10 and 11 is controlled by control unit 24 which receives signals of sensors 18, 19, 20, 21, 22 and 23 for the water temperature at the inlet port on the head side, water temperature at the inlet port on the block side, engine speed, vehicle speed, negative pressure of the intake pipe and outside air temperature. The numeral 25 denotes a transmission and the numeral 26 denotes a propeller shaft.

Now, referring to the operation, the first and second mixing valves 16 and 17 shut off the flow of water from the first and second radiators 8 and 9 until the temperature in the jacket reaches the predetermined level (approx. 60° C. on the head side and approx. 90° C. on the block side) after starting of the engine, and the first and second water pumps 4 and 5 promote warm-up of the engine by circulating the lowest limit of water so that no local overheating takes place in the engine.

Whilst the first and second water pumps 4 and 5 maintain the flow rate at which the temperature difference between the inlet and outlet ports of the jacket becomes approximately 5° C., the first and second mixing valves 16 and 17 control the mixing of the high temperature water coming from the first and second bypass passageways 14 and 15 with the low temperature water coming from the first and second radiators 8 and 9 in such a manner that the inlet port temperature sensed by the water temperature sensors 18 and 19 is maintained at the predetermined level.

Figure 2:
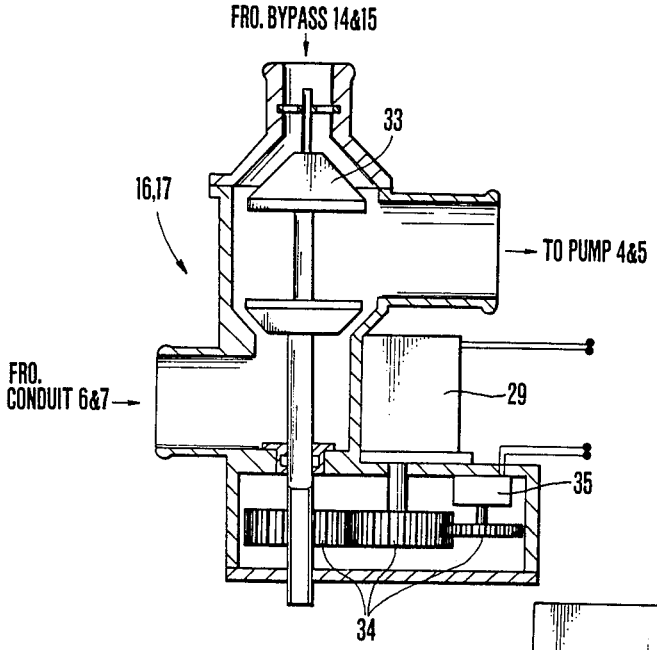
FIG. 2 shows a sectional plan view of one example of mixing valve in FIG. 1.
Figure 3:
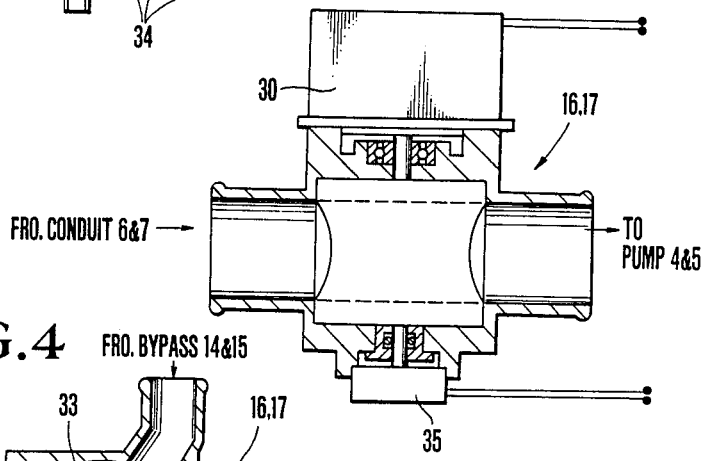
FIG. 3 shows sectional side view of another example of mixing valve.
Figure 4:
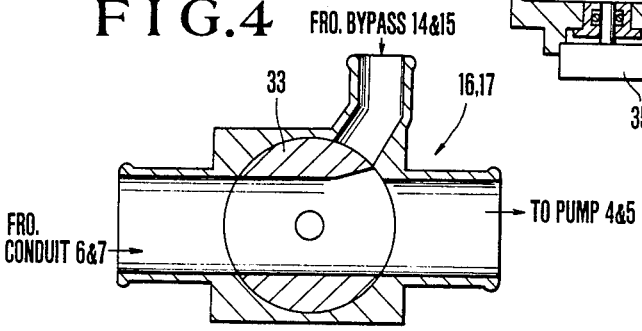
FIG. 4 shows the sectional plan view of the mixing valve of FIG. 3.

FIG. 2 through FIG. 4 show the details of the first and second mixing valves 16 and 17. The conical valve in FIG. 2 converts the rotation of the DC motor 29 to the stroke of control element 33 and determines the mixing ratio between the high temperature water and low temperature water. When the inlet port temperature signals from water temperature sensors 18 and 19 indicated temperature higher than the predetermined level, DC motor 29 rotates in the direction of controlling the amount of high temperature water coming from the bypass passageways 14 and 15, and when they indicate lower temperature, the motor rotates in the reverse direction. The upper limit and lower limit positions of control element 33 are detected by the resistance of potentiometer 35 interlocked with gear 34. Control unit 24 incorporates a circuit to compare the predetermined temperature with the inlet port temperature and has a function to decide the rotational direction of the motor depending on which temperature is higher.

FIG. 3 and FIG. 4 show a rotary valve which uses stepping motor 30. During normal operation, the first and second mixing valves 16 and 17 continue the operation mentioned above to maintain the temperature in each jacket 2 and 3 at an optimum level. It is generally known that this optimum temperature is within the range of 90° C. to 95° C. on the head side and 95° C. to 100° C. on the block side at such low loads as represented by travel in the urban area and within the range of 60° C. to 70° C. on the head side and 90° C. to 95° C. on the block side at such high loads as represented by high speed travel, high acceleration, and climbing. The level of the load is judged by the control unit from the negative pressure of the intake pipe.

When the inlet port temperature has exceeded the control range of mixing valves 16 and 17 (that is, within the stroke of control element 33 in FIG. 2) at a high load, control unit 24 issues a signal to increase the speed of the first and second water pumps 4 and 5 as the first step.

If the temperature exceeds the control range even in the highest range of the pump motors, motor fans 10 and 11 are rotated as the second step to maintain the temperature of the water in the first and second return passageways 12 and 13 at a low level. This step has a relationship to the current market needs for reduced noise level of the entire vehicle. Incidentally, since the operation of the motor fan mentioned here is to feed cooling air to the radiator, the speed of the motor fan is held at the required minimum level by control unit 24 if it judges that there is additional cooling effect brought about by the vehicle speed air.

It should be understood that, although the preferred embodiment of the present invention has been described herein in considerable detail, certain modifications, changes, and adaptations may be made by those skilled in the art and that it is hereby intended to cover all modifications, changes and adaptations thereof falling within the scope of the appended claims.

What is claimed is:

1. A cooling control system for internal combustion engines comprising:

a first radiator and a second radiator, a first water jacket provided to a cylinder head, a second water jacket provided to a cylinder block, a first water pump and a second water pump, being provided respectively at a position close to an inlet port at the upper-stream side of said first or second water jacket, a first conduit and a second conduit, connecting respectively an outlet port of said first or second water jacket to an inlet port of said first or second radiator, a first return passageway and a second return passageway, connecting respectively an outlet port of said first or second raditor to said first or second water pump, a first by-pass passageway and a second by-pass passageway, being respectively branched from said first or second conduit and communicating with said first or second return passageway, a first mixing valve device and a second mixing valve device, being positioned at the junction of said first or second by-pass passageway with said first or second return passageway, mixing water flows from said two passageways and returning it to said first or second water pump, a first motor fan and a second motor fan, sending cooled air to said first or second radiator respectively, each of said first and second water pumps being driven by an electric motor of which the rotation frequency is controllable, a valve equipped to each of said first and second mixing valve devices for determining the mixing ratio of water being driven by a direct current motor or a stepping motor, and rotation control of all said motors being performed by a control unit which operates by receiving the signals of engine rotation frequency, vehicle speed, suction force of suction pipe, temperature at the inlet ports of said first and second water jackets and ambient air temperature.

* * * * *